US010993861B2

(12) United States Patent
Bae et al.

(10) Patent No.: US 10,993,861 B2
(45) Date of Patent: May 4, 2021

(54) WEARABLE CHAIR HAVING FOUR-LINK STRUCTURE

(71) Applicants: HYUNDAI MOTOR COMPANY, Seoul (KR); KIA MOTORS CORPORATION, Seoul (KR)

(72) Inventors: Ki Hyeon Bae, Yongin-si (KR); Kyung Mo Jung, Seongnam-si (KR); Kyu Jung Kim, Seoul (KR); Ju Young Yoon, Suwon-si (KR); Dong Jin Hyun, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/533,084

(22) Filed: Aug. 6, 2019

(65) Prior Publication Data

US 2020/0155390 A1 May 21, 2020

(30) Foreign Application Priority Data

Nov. 20, 2018 (KR) ..... 10-2018-0143659

(51) Int. Cl.
*A61G 5/14* (2006.01)
*A47C 9/10* (2006.01)

(52) U.S. Cl.
CPC ..... *A61G 5/14* (2013.01); *A47C 9/10* (2013.01)

(58) Field of Classification Search
CPC ..... A61G 5/14; A47C 9/10; A47C 9/025
(Continued)

(56) References Cited

U.S. PATENT DOCUMENTS 2,173,569 A 9/1939 Troendle
4,138,156 A 2/1979 Bonner
(Continued)

FOREIGN PATENT DOCUMENTS

CN 104970607 A 10/2015
CN 106859122 A 6/2017
(Continued)

OTHER PUBLICATIONS

International Search Report dated Aug. 1, 2019 issued in International Patent Application No. PCT/KR2019/000518.
(Continued)

*Primary Examiner* — Anthony D Barfield
(74) *Attorney, Agent, or Firm* — Morgan, Lewis & Bockius LLP

(57) ABSTRACT

A wearable chair may include an upper rod extending in the longitudinal direction thereof, a lower rod, the upper end portion of the lower rod being rotatably coupled to the lower end portion of the upper rod, the lower end portion of the lower rod being configured to contact the ground when the user sits down, a lower leg fixing unit configured of extending in the longitudinal direction of the lower leg of the user to be coupled to the rear of the lower leg of the user, the distance between the lower leg fixing unit and the lower rod being varied when the lower leg fixing unit slides in the longitudinal direction of the lower rod, and a support rod having a lower end portion rotatably coupled to the lower rod and an upper end portion slidably coupled to the upper rod to slide within a specific section of the upper rod.

15 Claims, 7 Drawing Sheets

(58) Field of Classification Search
USPC ..... 297/4
See application file for complete search history.

(56) References Cited

U.S. PATENT DOCUMENTS

| | | | | |
|---|---|---|---|---|
| 10,271,660 | B2 * | 4/2019 | Gunura | A47C 9/025 |
| 2013/0320725 | A1 | 12/2013 | Conway | |
| 2019/0225131 | A1 | 7/2019 | Bellamy et al. | |
| 2020/0155390 | A1 | 5/2020 | Bae et al. | |

FOREIGN PATENT DOCUMENTS

| | | | |
|---|---|---|---|
| CN | 107252210 | A | 10/2017 |
| JP | 5883256 | B2 | 3/2016 |
| JP | 6107722 | B2 | 4/2017 |
| KR | 10-0690645 | B1 | 3/2007 |
| KR | 20-2008-0004603 | U | 10/2008 |
| KR | 20-0471438 | Y1 | 2/2014 |
| KR | 10-1500200 | B1 | 3/2015 |
| KR | 10-2015-0146169 | A | 12/2015 |
| KR | 10-2016-0007456 | A | 1/2016 |
| KR | 10-2017-0006632 | A | 1/2017 |
| KR | 10-2017-0036894 | A | 4/2017 |
| KR | 10-2017-0060783 | A | 6/2017 |
| KR | 10-1755806 | B1 | 7/2017 |
| KR | 10-2018-0083336 | A | 7/2018 |
| KR | 10-2020-0059360 | A | 5/2020 |
| WO | 2017/067705 | A1 | 4/2017 |
| WO | 2017/067706 | A1 | 4/2017 |

OTHER PUBLICATIONS

International Search Report dated Aug. 1, 2019 issued in International Patent Application No. PCT/KR2019/002151.
U.S. Non-Final Office Action dated Mar. 16, 2021 issued in U.S. Appl. No. 16/533,066.

* cited by examiner

WEARABLE CHAIR HAVING FOUR-LINK STRUCTURE

CROSS-REFERENCE TO RELATED APPLICATION

The present application claims priority to Korean Patent Application No. 10-2018-0143659, filed on Nov. 20, 2018, the entire contents of which is incorporated herein for all purposes by this reference.

BACKGROUND OF THE INVENTION

Field of the Invention

The present invention relates to a wearable chair having a four-link structure, and more particularly to a wearable chair having a four-link structure which is capable of spacing the ground contact point of a lower rod apart from the foot of a user when the user sits down.

Description of Related Art

In recent years, research has been actively conducted into a multi-purpose wearable robot that can be used to assist handicapped people or the old and the weak in moving or to rehabilitate muscular dystrophy patients in the medical field, to assist soldiers in easily bearing heavy soldiers' kits in the military field, and to assist workers in easily carrying heavy loads in industrial fields.

In general, a wearable robot is manufactured by organically coupling links, which are configured to perform joint actions similar to those of human beings, into a shape that a user can wear. In the case in which a user wears a wearable robot, the wearable robot supplements the physical strength of the thigh or the lower leg of the user such that the user can perform high-load work requiring force beyond the general physical strength limits of human beings without the help of an additional external device.

However, an active type wearable robot, which is power-driven to supplement the physical strength of human beings, is relatively heavy, and needs to be controlled using a controller, which is complicated. As a result, the stability of the present type of wearable robot is low.

Furthermore, the distance between the ground contact point of a lower rod and the foot of a user is not uniform when the user sits down, whereby sitting stability is low.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a wearable chair having a four-link structure which is configured for supporting a heavy load while being lightweight and maintaining a uniform distance between the ground contact point of a lower rod and the foot of a user when the user sits down, whereby sitting stability is improved.

In accordance with various aspects of the present invention, the above and other objects may be accomplished by the provision of a wearable chair having a four-link structure, the wearable chair including an upper rod extending in the longitudinal direction thereof and configured to be connected to the rear of the thigh of a user, a lower rod extending from the rear of the lower leg of the user in the longitudinal direction thereof, the upper end portion of the lower rod being rotatably coupled to the lower end portion of the upper rod, the lower end portion of the lower rod being configured to contact the ground when the user sits down, a lower leg fixing unit configured of extending in the longitudinal direction of the lower leg of the user to be coupled to the rear of the lower leg of the user, the distance between the lower leg fixing unit and the lower rod being varied when the lower leg fixing unit slides in the longitudinal direction of the lower rod, and a support rod having a lower end portion rotatably coupled to the lower rod and an upper end portion slidably coupled to the upper rod to slide within a specific section of the upper rod.

The wearable chair may further include a sliding unit slidably coupled to the lower rod to slide in the longitudinal direction of the lower rod, a first connection unit coupled to the sliding unit and to the lower leg fixing unit of interconnecting the sliding unit and the upper portion of the lower leg fixing unit, and a second connection unit having one end portion rotatably coupled to the lower portion of the lower leg fixing unit and the other end portion rotatably coupled to the lower portion of the lower rod, wherein, when the sliding unit slides along the lower rod, the second connection unit may be rotated, whereby the distance between the lower leg fixing unit and the lower rod may be varied.

A rail may be provided in the longitudinal direction of the lower rod, and the sliding unit may be slidable along the rail in the longitudinal direction of the lower rod.

The lower rod may include a first elastic member for applying elastic force in the direction in which the sliding unit is pulled downwards, and when the sliding unit slides downwards due to the elastic force of the first elastic body, the lower rod may move upwards from the lower leg fixing unit, whereby the distance between the lower leg fixing unit and the lower rod may be reduced.

When the lower rod is pushed and thus the sliding unit slides upwards, the lower rod may move downwards from the lower leg fixing unit, whereby the distance between the lower leg fixing unit and the lower rod may be increased.

The wearable chair may further include a switch slidably coupled to the upper rod to slide in the longitudinal direction of the upper rod and to be selectively fixed at a plurality of points such that sliding of the switch is stopped, wherein, when the switch is fixed to the upper rod, the sliding of the support rod along the upper rod may be stopped by the switch, whereby relative rotation between the upper rod and the lower rod may be prevented.

The switch may be provided at one end portion thereof with a coupling protrusion, which protrudes toward the upper rod, and the upper rod may be provided at a plurality of points thereof with coupling recesses such that, when the coupling protrusion is inserted into one of the coupling recesses, the switch is fixed to the upper rod and the sliding of the switch along the upper rod is stopped.

The switch may include a body portion, on which the coupling protrusion is formed, and a rotation member rotatably coupled to the body portion, the rotation member having a first bearing formed at one end portion thereof, and wherein, when the rotation member is rotated relative to the body portion, the first bearing may be exposed in the direction in which the coupling protrusion protrudes, whereby the coupling protrusion may be separated from one of the coupling recesses.

The body portion may be provided with a support member protrudingly formed in a direction opposite to the direction in which the coupling protrusion protrudes, and the other end portion of the rotation member may extend to be disposed at an oblique angle relative to the support member such that, when the other end portion of the rotation member is pushed toward the support member, the rotation member is rotated relative to the body portion.

The support rod may be provided at the upper end portion thereof with a second bearing, configured to be rotated such that the support rod slides along the upper rod.

The second bearing may be coupled to the support rod to move in a pushing recess formed in the upper end portion of the support rod such that the second bearing is exposed out of the support rod toward the upper rod or is inserted into the support rod, and the support rod may be provided with a third elastic member for pushing the second bearing such that the second bearing is exposed outwards toward the upper rod along the pushing recess.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
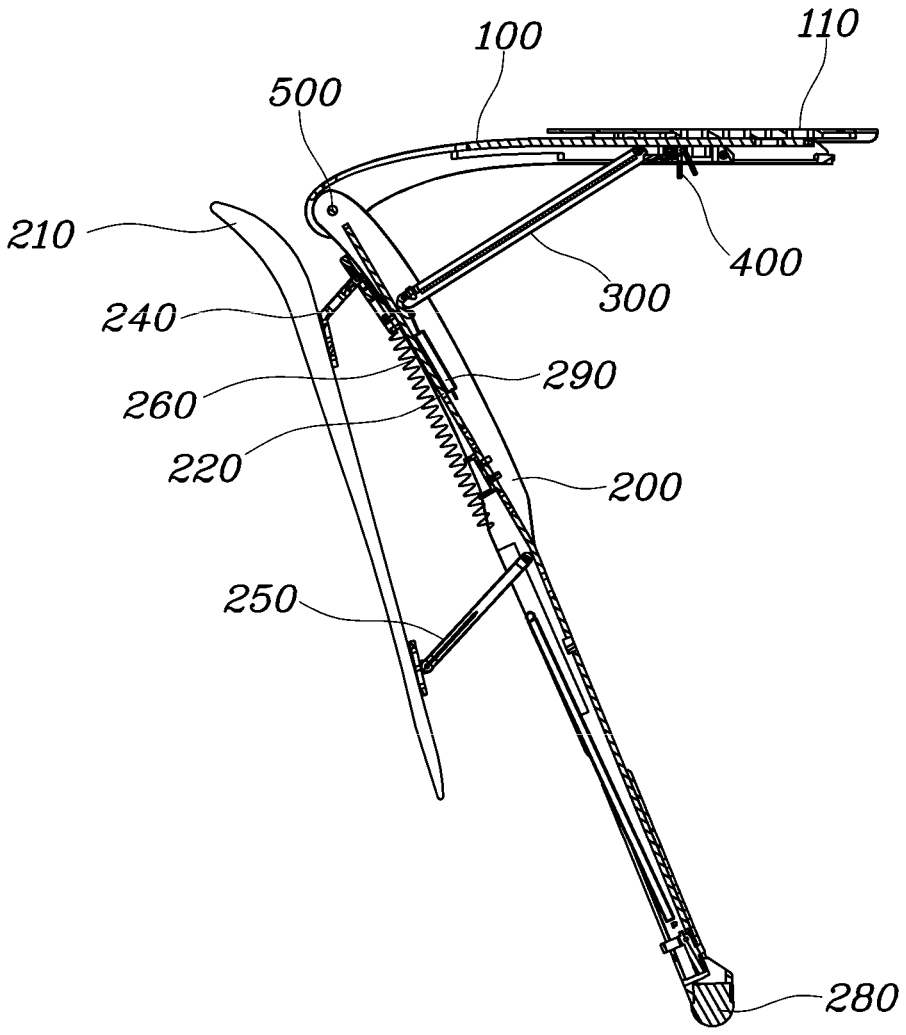
FIG. 1 is a sectional view showing a wearable chair having a four-link structure according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Specific structural or functional descriptions of the exemplary embodiments of the present invention disclosed in the exemplary embodiment or the present disclosure are provided only for illustrating embodiments of the present invention. Embodiments of the present invention may be realized in various forms, and should not be interpreted to be limited to the exemplary embodiments of the present invention disclosed in the exemplary embodiment or the present disclosure.

Since the exemplary embodiments of the present invention may be variously modified and may have various forms, specific embodiments will be shown in the drawings and will be described in detail in the exemplary embodiment or the present disclosure. However, the exemplary embodiments according to the concept of the present invention are not limited to such specific embodiments, and it should be understood that the present invention includes all alterations, equivalents, and substitutes that fall within the idea and technical scope of the present invention.

It will be understood that, although the terms "first", "second", etc. may be used herein to describe various elements, corresponding elements should not be understood to be limited by these terms, which are used only to distinguish one element from another. For example, within the scope defined by the present invention, a first element may be referred to as a second element, and similarly, a second element may be referred to as a first element.

It will be understood that when a component is referred to as being "connected to" or "coupled to" another component, it may be directly connected to or coupled to the other component, or intervening components may be present. In contrast, when a component is referred to as being "directly connected to" or "directly coupled to" another component, there are no intervening components present. Other terms that describe the relationship between components, such as "between" and "directly between" or "adjacent to" and "directly adjacent to", must be interpreted in the same manner.

The terms used in the exemplary embodiment are provided only to explain specific embodiments, but are not intended to restrict the present invention. A singular representation may include a plural representation unless it represents a definitely different meaning from the context. It will be further understood that the terms "comprises", "has" and the like, when used in the exemplary embodiment, specify the presence of stated features, numbers, steps, operations, elements, components or combinations thereof, but do not preclude the presence or addition of one or more other features, numbers, steps, operations, elements, components, or combinations thereof.

Unless otherwise defined, all terms, including technical and scientific terms, used in the exemplary embodiment have the same meanings as those commonly understood by a person having ordinary skill in the art to which the present invention pertains. It will be further understood that terms, such as those defined in commonly used dictionaries, should be interpreted as having meanings consistent with their meanings in the context of the relevant art and the present invention, and are not to be interpreted in an idealized or overly formal sense unless expressly so defined herein.

Reference will now be made in detail to the exemplary embodiments of the present invention, examples of which are illustrated in the accompanying drawings. Wherever possible, the same reference numbers will be used throughout the drawings to refer to the same or like parts.

Figure 2:
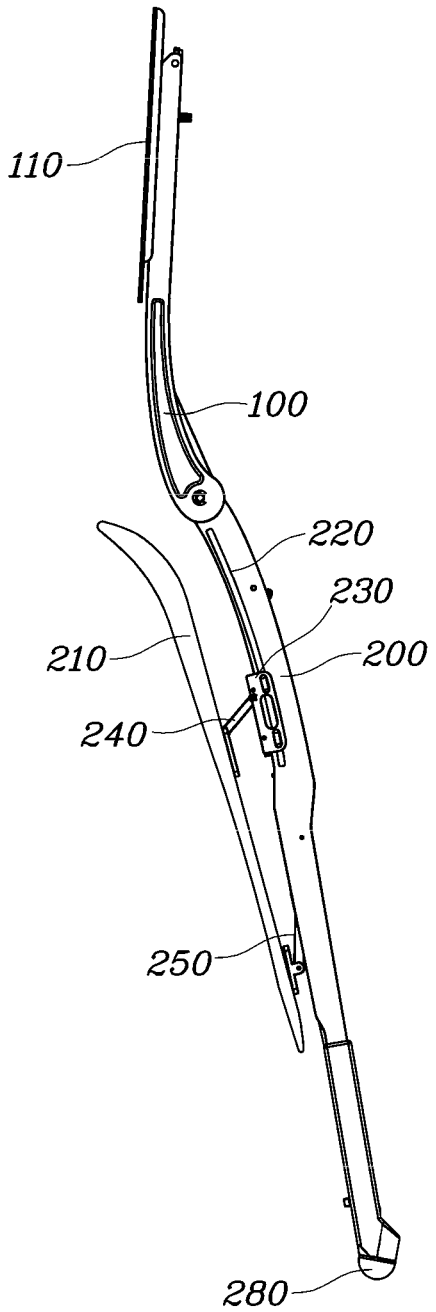
FIG. 2 is a view showing the state in which the wearable chair having the four-link structure according to the exemplary embodiment of the present invention is unfolded.
Figure 3:
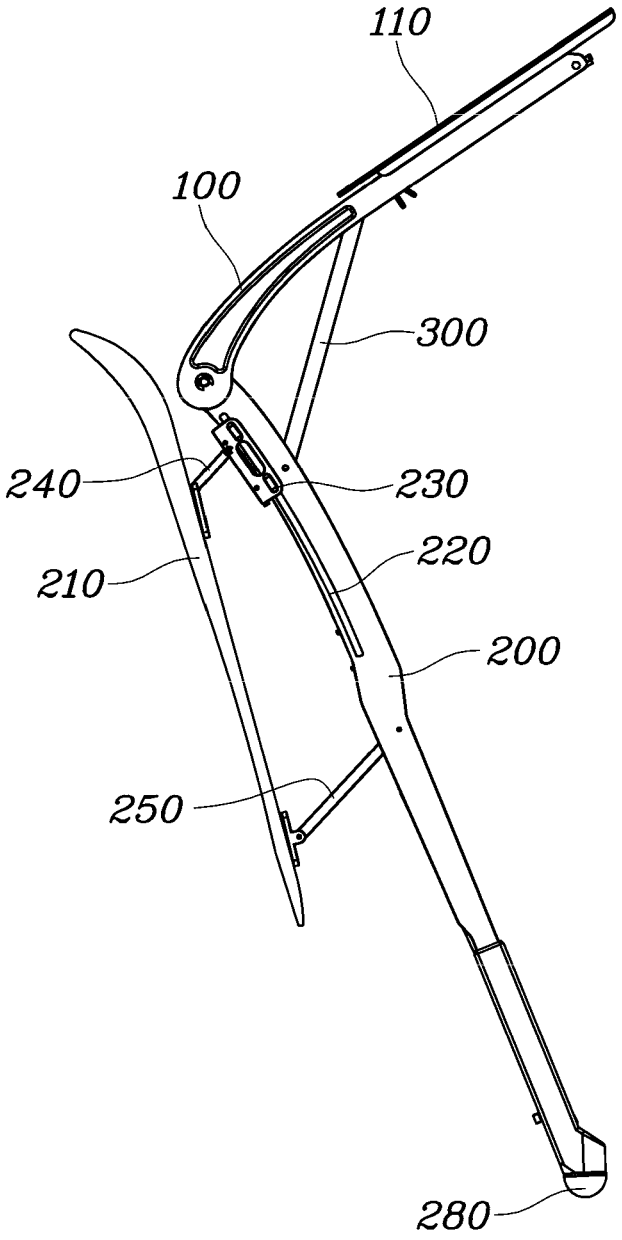
FIG. 3 is a view showing the state in which the wearable chair having the four-link structure according to the exemplary embodiment of the present invention is folded.
Figure 4:
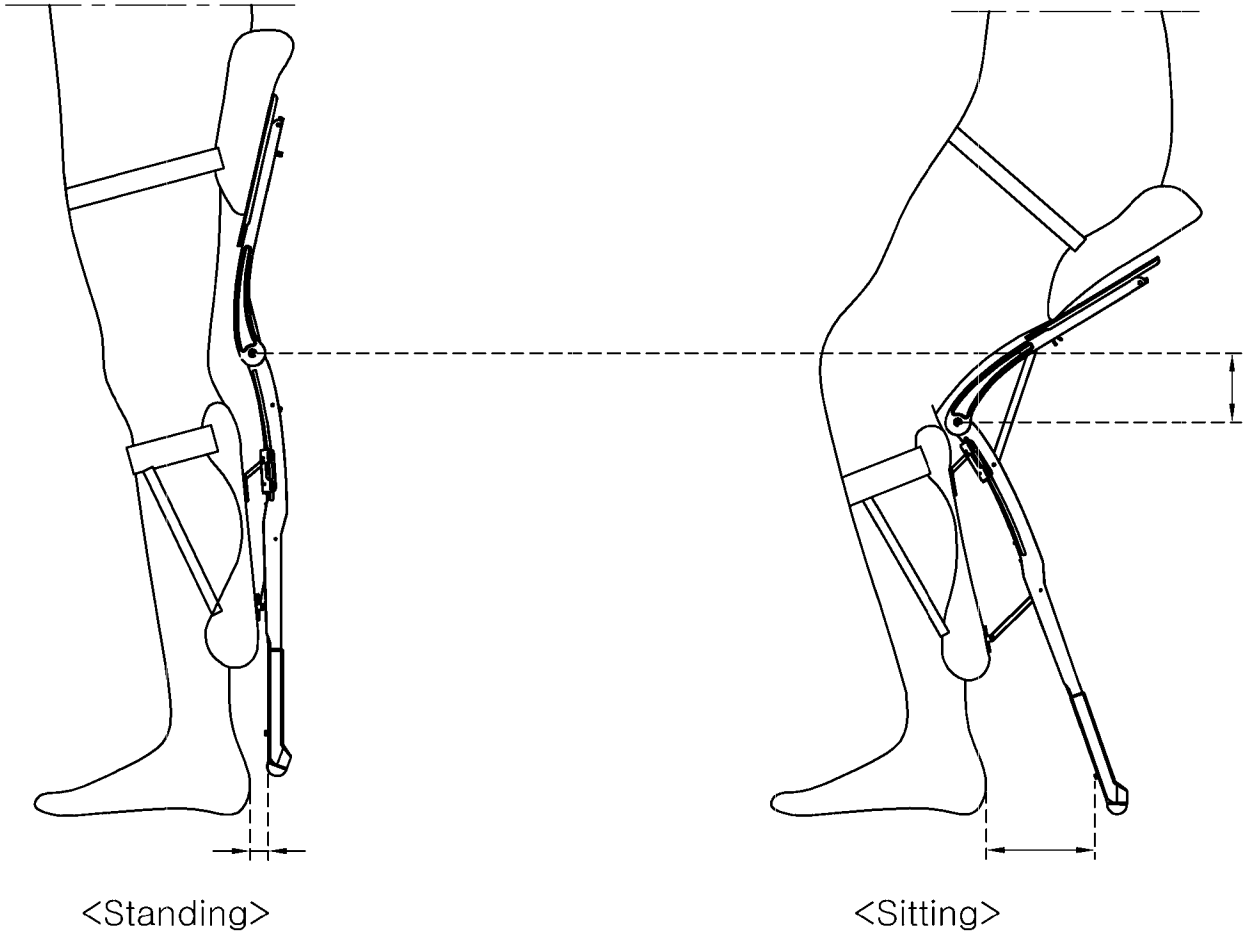
FIG. 4 is a view showing the state in which a user wears the wearable chair having the four-link structure according to the exemplary embodiment of the present invention.

FIG. 1 is a sectional view showing a wearable chair having a four-link structure according to an exemplary embodiment of the present invention, FIG. 2 is a view showing the state in which the wearable chair having the four-link structure according to the exemplary embodiment of the present invention is unfolded, FIG. 3 is a view showing the state in which the wearable chair having the four-link structure according to the exemplary embodiment of the present invention is folded, and FIG. 4 is a view showing the state in which a user wears the wearable chair having the four-link structure according to the exemplary embodiment of the present invention.

Referring to FIGS. 1 to 4, the wearable chair having the four-link structure according to the exemplary embodiment of the present invention includes an upper rod 100, extending in the longitudinal direction thereof and configured to be connected to the rear of the thigh of a user, a lower rod 200, extending from the rear of the lower leg of the user in the longitudinal direction thereof, the upper end portion of the lower rod 200 being rotatably coupled to the lower end portion of the upper rod 100, the lower end portion 280 of the lower rod 200 being configured to contact the ground when the user sits down, a lower leg fixing unit 210, extending in the longitudinal direction of the lower leg of the user to be coupled to the rear of the lower leg of the user, the distance between the lower leg fixing unit 210 and the lower rod 200 being varied when the lower leg fixing unit 210 slides in the longitudinal direction of the lower rod 200, and a support rod 300, having a lower end portion rotatably coupled to the lower rod 200 and an upper end portion coupled to the upper rod 100 to slide within a specific section of the upper rod 100.

The upper rod 100 is an element that corresponds to the thigh of the user, and may be directly coupled to the rear of the thigh of the user using a harness, or may be connected to the rear of the thigh of the user via thigh support members 110, which tightly contact to the thigh of the user, coupled using a harness. The upper rod 100 may extend in the longitudinal direction thereof to be parallel to the direction in which the thigh of the user extends.

The lower rod 200 may extend in the longitudinal direction thereof to be parallel to the direction in which the lower leg of the user extends. The lower rod 200 is an element that corresponds to the lower leg of the user, and may be connected to the lower leg of the user via the lower leg fixing unit 210, which is directly coupled to the lower leg of the user. The lower leg fixing unit 210 may be formed to tightly contact the lower leg of the user.

The upper end portion of the lower rod 200 may be rotatably coupled to the lower end portion of the upper rod 200 via a hinge 500.

When the user sits down, the lower end portion 280 of the lower rod 200 may contact the ground. When the user stands up, the lower end portion 280 of the lower rod 200 may move upwards to be separated from the ground.

When the user sits down, the lower end portion 280 of the lower rod 200 may contact the ground at the rear of the foot of the user to support the seated posture of the user. The lower end portion 280 of the lower rod 200, which contacts the ground, may include a material that exhibits high frictional force, such as rubber. Furthermore, the lower rod 200 may slide and be fixed such that the length of the lower rod 200 is adjusted in consideration of the height of the user.

The lower end portion of the support rod 300 is rotatably coupled to the lower rod 200, and the upper end portion of the support rod 300 is coupled to the upper rod 100 to slide within a specific section of the upper rod 100. When the upper rod 100 and the lower rod 200 are rotated relative to each other, therefore, the lower end portion of the support rod 300 may be rotated relative to the lower rod 200, and the upper end portion of the support rod 300 may slide along the upper rod 100.

The wearable chair may further include a sliding unit 230, coupled to the lower rod 200 to slide in the longitudinal direction of the lower rod 200, a first connection unit 240, coupled to the sliding unit 230 and to the lower leg fixing unit 210 for interconnecting the sliding unit 230 and the upper portion of the lower leg fixing unit 210, and a second connection unit 250, having one end portion rotatably coupled to the lower portion of the lower leg fixing unit 210 and the other end portion rotatably coupled to the lower portion of the lower rod 200. When the sliding unit 230 slides along the lower rod 200, the second connection unit 250 may rotate, whereby the distance between the lower leg fixing unit 210 and the lower rod 200 may be varied.

The sliding unit 230 is coupled to the lower rod 200 to slide in the longitudinal direction of the lower rod 200, and is connected to the lower leg fixing unit 210 via the first connection unit 240. A rail 220 may be provided in the longitudinal direction of the lower rod 200, and the sliding unit 230 may slide along the rail 220 in the longitudinal direction of the lower rod 200.

That is, the sliding unit 230 slides along the rail 220 formed in the longitudinal direction of the lower rod 200, whereby the sliding unit 230 easily slides in the longitudinal direction of the lower rod 200.

One end portion of the first connection unit 240 may be coupled to the upper portion of the lower leg fixing unit 210, and the other end portion of the first connection unit 240 may be coupled to the sliding unit 230. One end portion or the other end portion of the first connection unit 240 may be fixedly coupled to the upper portion of the lower leg fixing unit 210 or to the sliding unit 230. In another exemplary embodiment of the present invention, one end portion or the other end portion of the first connection unit 240 may be rotatably coupled to the upper portion of the lower leg fixing unit 210 or to the sliding unit 230.

The second connection unit 250 connects the lower portion of the lower leg fixing unit 210 to the lower rod 200. One end portion of the second connection unit 250 may be rotatably coupled to the lower portion of the lower leg fixing unit 210, and the other end portion of the second connection unit 250 may be rotatably coupled to the lower portion of the lower rod 200.

That is, the lower leg fixing unit 210 is coupled to the lower rod 200 through a four-link structure. When the sliding unit 230 slides along the lower rod 200, the second connection unit 250 is rotated to be unfolded or folded, whereby the distance between the lower leg fixing unit 210 and the lower rod 200 may be varied.

When the user sits down, the lower rod 200 moves downwards relative to the lower leg fixing unit 210, and the lower end portion 280 of the lower rod 200 contacts the ground. At the instant time, the lower end portion 280 of the lower rod 200 is located to be spaced from the foot of the user through the four-link structure, whereby sitting stability is improved.

When the second connection unit 250 is rotated in the state of being coupled to the lower portion of the lower leg fixing unit 210, the lower rod 200 is also rotated somewhat, whereby the distance between the lower portion of the lower rod 200 and the lower leg fixing unit 210 is varied more greatly. As a result, the distance between the lower end portion 280 of the lower rod 200 and the foot of the user is varied greatly.

The lower rod 200 includes a first elastic member 260 for applying elastic force in the direction in which the sliding unit 230 is pulled downwards. When the sliding unit 230 slides downwards due to the elastic force of the first elastic member 260, the lower rod 200 moves upwards from the lower leg fixing unit 210, whereby the distance between the lower leg fixing unit 210 and the lower rod 200 may be reduced.

When the sliding unit 230 slides downwards due to the elastic force of the first elastic member 260, the lower rod 200 may be pulled upwards from the sliding unit 230 due to the elastic force of the first elastic member 260. Since the lower leg fixing unit 210 is fixed to the lower leg of the user, the lower rod 200 may move upwards from the lower leg fixing unit 210. The second connection unit 250 is folded when the lower rod 200 moves upwards, whereby the distance between the lower leg fixing unit 210 and the lower rod 200 may be reduced.

Consequently, in the state in which the user is standing, in which the weight of the user is not applied to the wearable chair, the lower rod 200 is pulled upwards from the lower leg fixing unit, which is coupled to the lower leg of the user. That is, in the state in which the user is standing, the lower end portion 280 of the lower rod 200 remains raised so as not to contact the ground, whereby interference with walking of the user is minimized.

On the other hand, when the lower rod 200 is pushed and thus the sliding unit 230 slides upwards, the lower rod 200 moves downwards from the lower leg fixing unit 210, whereby the distance between the lower leg fixing unit 210 and the lower rod 200 may be increased.

When the user sits downs, the upper rod 100 and the lower rod 200 are rotated about the hinge 500, whereby the lower rod 200 is pushed downwards. As a result, the lower rod 200 slides downwards from the sliding unit 230 against the elastic force of the first elastic member 260, and the sliding unit 230 slides upwards relative to the lower rod 200.

That is, the lower rod 200 moves downwards from the lower leg fixing unit 210, which is coupled to the sliding unit 230, and the distance between the lower leg fixing unit 210 and the lower rod 200 may be increased by the second connection unit 250, which is unfolded when the lower rod 200 moves upwards. Since the second connection unit 250 is coupled to the lower portion of the lower leg fixing unit 210, the distance between the lower end portion 280 of the lower rod 200 and the foot of the user is relatively greatly increased when the lower rod 200 rotates.

Consequently, the lower end portion 280 of the lower rod 200 contacts the ground at a point spaced from the heel of the user, whereby stable supporting force may be secured.

A second elastic member 290 may apply rotational force necessary to rotate the support rod 300 in a direction identical to the direction in which the upper rod 100 is unfolded from the lower rod 200. That is, as shown, the second elastic member 290 applies rotational force at the lower end portion of the support rod 300 such that the support rod 300 is rotated in the counterclockwise direction thereof. The second elastic member 290 may apply rotational force such that the upper end portion of the support rod 300 is rotated toward the upper rod 100, whereby the upper end portion of the support rod 300 constantly contacts the upper rod 100.

To the present end, one end portion of the second elastic member 290 may be fixed to the lower rod 200, and the other end portion of the second elastic member 290 may be directly coupled to the lower end portion of the support rod 300. Alternatively, the other end portion of the second elastic member 290 may be indirectly coupled to the lower end portion of the support rod 300 via an additional ring-shaped member.

In another exemplary embodiment of the present invention, the second elastic member 290 may be configured as a coil spring, one end portion of which is fixed to the lower rod 200 to surround the hinge 500, about which the support rod 300 is rotated relative to the lower rod 200, and the other end portion of which is coupled to the lower end portion of the support rod 300.

The rotational force of the second elastic member 290 does not need to be so great that the upper rod 100 can rotate from the lower rod 200, but simply needs to be at a level sufficient for the upper end portion of the support rod 300 to contact the upper rod 100 at the time of sliding. As a result, the upper end portion of the support rod 300 slides along the upper rod 100 in the state of being in constant contact with the upper rod 100. Furthermore, a second bearing 310, a description of which will follow, is constantly in contact with the upper rod 100, whereby the support rod 300 smoothly slides.

Figure 5:
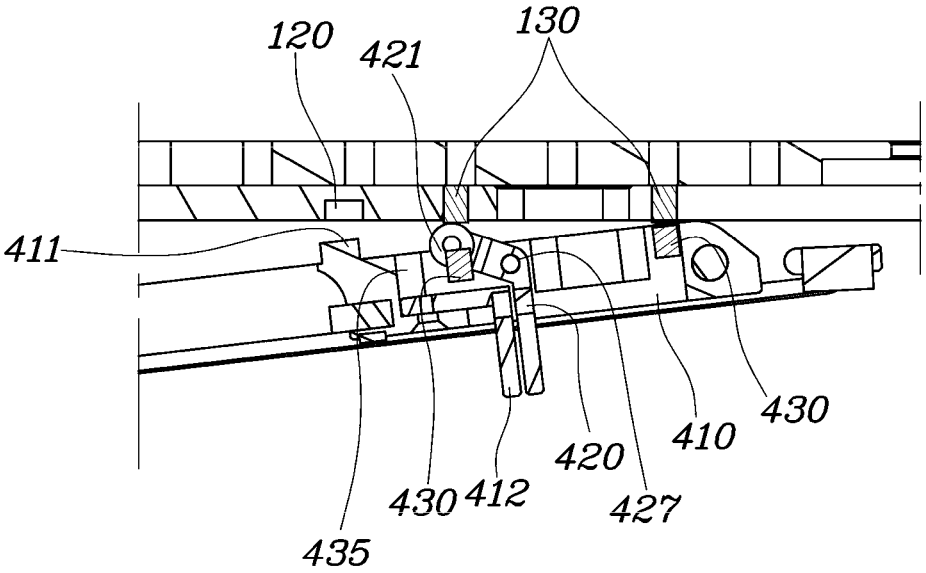
FIG. 5 is a view showing the relationship of coupling between an upper rod and a switch of the wearable chair having the four-link structure according to the exemplary embodiment of the present invention.

FIG. 5 is a view showing the relationship of coupling between the upper rod 100 and a switch 400 of the wearable chair having the four-link structure according to the exemplary embodiment of the present invention.

Further referring to FIG. 5, the wearable chair may further include a switch 400 coupled to the upper rod 100 to slide in the longitudinal direction of the upper rod 100 and to be selectively fixed at a plurality of points such that the sliding of the switch is stopped. When the switch 400 is fixed to the upper rod 100, the sliding of the support rod 300 along the upper rod 100 is stopped by the switch 400, whereby relative rotation between the upper rod 100 and the lower rod 200 is prevented.

The switch 400 may slide along the upper rod 100 in a direction parallel to or identical to the direction in which the upper end portion of the support rod 300 slides. When the switch 400 slides along the upper rod 100, the position at which the sliding of the upper end portion of the support rod 300 along the upper rod 100 is stopped may be varied.

The switch 400 may be selectively coupled to the upper rod 100 such that the sliding of the switch 400 is stopped at a plurality of positions. For instance, the switch 400 may be coupled to the upper rod 100 continuously, or may be coupled to the upper rod 100 at a plurality of positions spaced from each other.

In the case in which the switch 400 is fixed to the upper rod 100, the sliding of the support rod 300 along the upper rod 100 is stopped by the switch 400, whereby relative rotation between the upper rod 100 and the lower rod 200 is prevented. As the fixed position of the switch 400 is varied, the angle at which relative rotation between the upper rod 100 and the lower rod 200 is prevented may be varied.

When the user sits down, the weight of the user is applied to the upper rod 100, and when the angle of relative rotation between the lower rod 200 and the upper rod 100 is fixed by the support rod 300, the weight of the user applied to the upper rod 100 is transmitted to the lower rod 200 via the support rod 300.

When the user sits down, therefore, the angle between the lower rod 200 and the upper rod 100, i.e., the sitting angle, may be changed as the fixed position of the switch 400 on the upper rod 100 is changed. Consequently, it is possible for the user to easily change the sitting angle.

The switch 400 is provided at one end portion thereof with a coupling protrusion 411, which protrudes toward the upper rod 100, and the upper rod 100 is provided at a plurality of points thereof with coupling recesses 120. When the coupling protrusion 411 is inserted into one of the coupling recesses 120, therefore, the switch 400 may be fixed such that the sliding of the switch 400 along the upper rod 100 is stopped.

The switch 400 may extend in the longitudinal direction of the upper rod 100, and the coupling protrusion 411, which protrudes toward the upper rod 100, may be formed at one end portion of the switch 400. The coupling recesses 120 may be formed at a plurality of points of the upper rod 100 spaced from each other in the longitudinal direction thereof. The coupling protrusion 411 protrudes toward the upper rod 100 to be inserted into one of the coupling recesses 120 formed in the upper rod 100. As a result, the switch 400 is fixed, whereby the sliding of the switch 400 along the upper rod 100 is stopped.

The switch 400 includes a body portion 410, on which the coupling protrusion 411 is formed, and a rotation member 420 rotatably coupled to the body portion 410 by a hinge 427, the rotation member 420 having a first bearing 421 formed at one end portion thereof. When the rotation member 420 is rotated relative to the body portion 410, the first bearing 421 is exposed in the direction in which the coupling protrusion 411 protrudes, whereby the coupling protrusion 411 may be separated from one of the coupling recesses 120.

The body portion 410 of the switch 400 may extend in the longitudinal direction of the upper rod 100, and the protrusion 411 may be formed at one end portion of the body portion 410. The first bearing 421 may be formed at one end portion of the rotation member 420, and the rotation member 420 may be rotatably coupled to the body portion 410 by the hinge 427.

The first bearing 421 of the rotation member 420 is inserted into the body portion 410 in the state in which the coupling protrusion 411 of the body portion 410 is inserted into one of the coupling recesses 120. When the rotation member 420 is rotated relative to the body portion 410, the first bearing 421 is exposed in the direction in which the coupling protrusion 411 protrudes, whereby the coupling protrusion 411 may be separated from one of the coupling recesses 120. That is, the first bearing 421 is rotated to be exposed in the direction in which the coupling protrusion 411 protrudes, whereby the coupling protrusion 411 is separated from one of the coupling recesses 120.

As a result, the first bearing 421 is exposed and contracts the upper rod 100 in the state in which coupling between the coupling protrusion 411 and one of the coupling recesses 120 is released, whereby the switch 400 may smoothly slide.

In an exemplary embodiment of the present invention, the first bearing 421 of the rotation member 420 is inserted into a receiving hole 435 formed on the body portion 410 in the state in which the coupling protrusion 411 of the body portion 410 is inserted into one of the coupling recesses 120. As a result, the first bearing 421 is exposed out of the receiving hole 435 and contracts the upper rod 100 in the state in which coupling between the coupling protrusion 411 and one of the coupling recesses 120 is released, whereby the switch 400 may smoothly slide.

The body portion 410 may be provided with a support member 412, configured to protrude in the direction opposite to the direction in which the coupling protrusion 411 protrudes, and the other end portion of the rotation member 420 may extend to be disposed at an oblique angle relative to the support member 412 such that, when the other end portion of the rotation member 420 is pushed toward the support member 412, the rotation member 420 is rotated relative to the body portion 410.

The support member 412 may be integrally formed with the body portion 410, or may be securely fixed to the body portion 410. The other end portion of the rotation member 420 may extend to be disposed at an oblique angle relative to the support member 412 in the direction opposite to the direction in which the coupling protrusion 411 protrudes. That is, one end portion of the rotation member 420 may be exposed in the direction in which the coupling protrusion 411 protrudes, and the other end portion of the rotation member 420 may extend through the body portion 410 in the direction opposite to the direction in which the coupling protrusion 411 protrudes such that the middle of the rotation member 420 is rotatably coupled to the body portion 410.

The other end portion of the rotation member 420 may extend to be disposed at an oblique angle relative to the support member 412 such that, when the other end portion of the rotation member 420 is pushed toward the support member 412, the rotation member 420 rotates relative to the body portion 410. In the state in which the first bearing 421, formed at one end portion of the rotation member 420, is inserted into the body portion 410, the other end portion of the rotation member 420 may extend to be disposed at an oblique angle relative to the support member 412. When the other end portion of the rotation member 420 is pushed toward the support member 412 and thus is disposed parallel to the support member 412, the first bearing 421 is rotated to be exposed in the direction in which the coupling protrusion 411 protrudes, whereby the coupling protrusion 411 may be separated from one of the coupling recesses.

Consequently, it is possible to easily release the fixation of the switch by pushing the other end portion of the rotation member 420, whereby it is possible to easily change the position of the switch 400.

The switch 400 may be formed to correspond to the shape of the upper end portion of the support rod 300. The switch 400 may be formed to have a shape that surrounds the upper end portion of the support rod 300. That is, the switch 400, which supports the upper end portion of the support rod, which is rounded as shown, may be formed to have a shape that surrounds the upper end portion of the support rod 300. As a result, the pressure of the switch 400 which is applied to the support rod 300 may be dispersed.

At each position of the switch 400 at which the coupling protrusion 411 on the switch 400 is inserted into one of the coupling recesses 120 in the upper rod 100, the switch 400 and the upper rod 100 may be provided with magnets 430 and 130, which surface each other to attract each other. The switch 400 and the upper rod 100 may have permanent magnets disposed such that N poles and S poles thereof surface each other to attract each other.

The magnets 430 and 130, which attract each other, may be provided at the switch 400 and the upper rod 100, respectively. The magnets 430 and 130, which are provided at the switch 400 and the upper rod 100, respectively, have relatively low attractive force, the attractive force being necessary to guide the coupling protrusion 411 on the switch member 400 toward one of the coupling recesses 120 in the first rod 100 such that the coupling protrusion 411 is inserted into one of the coupling recesses 120. The attractive force of the magnets 430 and 130 is used to locate the switch 400 at a predetermined position such that the coupling protrusion 411 is inserted into one of the coupling recesses 120, which are spaced from each other.

The sliding of the switch 400 along the upper rod 100 may be stopped using the attractive force of the magnets 430 and 130. However, the attractive force of the magnets 430 and 130 is relatively low. If magnets 430 and 130 having high attractive force are used, it is difficult to change the position of the switch 400.

A plurality of magnets 430 may be provided at the switch 400 to be spaced from the coupling protrusion 411, and a plurality of magnets 130 may be provided at the upper rod 100 to correspond to the magnets 430 provided at the switch 400 at each position of the switch 400 at which the coupling protrusion 411 on the switch 400 is inserted into one of the coupling recesses 120 in the upper rod 100.

To prevent the attractive force of the magnets 430 and 130 from impeding the separation of the coupling protrusion 411 from one of the respective coupling recesses 120, the magnets 430 may be located to be spaced from the coupling protrusion 411. The magnets 430 are spaced from each other such that the switch member 400 is stably supported by the upper rod 100 due to the attractive force of the magnets.

As shown, the switch 400 may be provided with two magnets 430 spaced from each other in the sliding direction thereof, and the coupling recesses 110 may be formed in the upper rod 100 to be spaced from each other with a predetermined distance. At each position of the switch 400 at which the coupling protrusion 411 on the switch 400 is inserted into one of the coupling recesses 120 in the upper rod 100, the magnets 120 may be provided at the upper rod 100, and the magnets 120 provided at the upper rod 100 may be disposed at the same interval such that some of the magnets overlap each other.

Figure 6A:
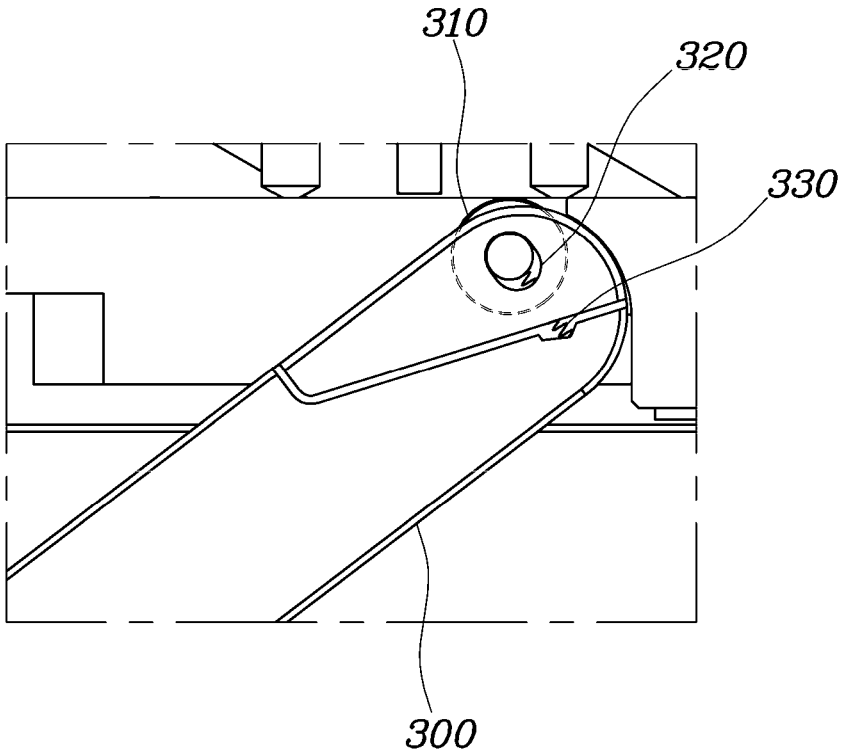
FIG. 6A and FIG. 6B are views showing the upper end portion of a support rod of the wearable chair having the four-link structure according to the exemplary embodiment of the present invention.
Figure 6B:
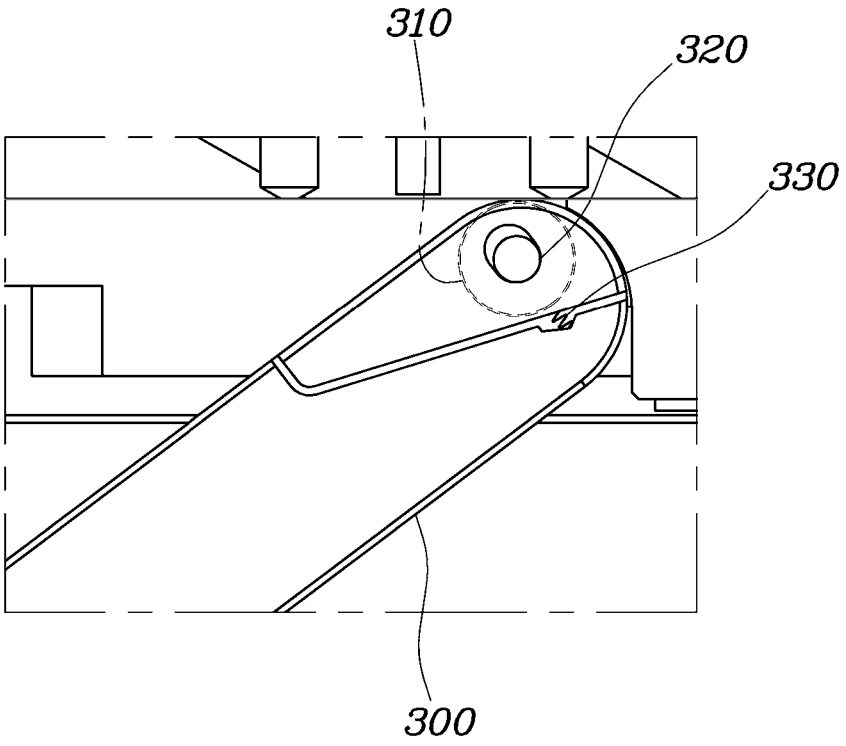

FIG. 6A and FIG. 6B are views showing the upper end portion of the support rod 300 of the wearable chair having the four-link structure according to the exemplary embodiment of the present invention.

Referring to FIG. 6A and FIG. 6B, a second bearing 310, configured to be rotated such that the support rod 300 slides along the upper rod 100, may be formed at the upper end portion of the support rod 300.

The second bearing 310 may be coupled to the upper end portion of the support rod 300 such that the support rod 300 is rotated about a rotation shaft perpendicular to the longitudinal direction of the upper rod 100, along which the support rod 300 slides. When the support rod 300 slides along the upper rod 100, therefore, the support rod 300 may move smoothly due to the second bearing 310.

The second bearing 310 may be coupled in a pushing recess 320 to the support rod 300 to move in the pushing recess 320 formed in the upper end portion of the support rod 300 such that the second bearing 300 is exposed out of the support rod 300 toward the upper rod 100, as shown in FIG. 6A, or is inserted into the support rod 300, as shown in FIG. 6B.

Furthermore, the support rod 300 may be provided with a third elastic member 330 for pushing the second bearing 310 such that the second bearing 300 is exposed outwards toward the upper rod 100 along the pushing recess 320.

The second bearing 310 may be coupled to the upper end portion of the support rod 300, and may be coupled into the pushing recess 320 to slightly move relative to the support rod 300. The pushing recess 320 may be formed in the upper end portion of the support rod 300 such that the rotation shaft of the second bearing 310 may be moved, and the second bearing 310 may be exposed outwards toward the upper rod 100 in the pushing recess 320, or may move to be inserted into the support rod 300.

The third elastic member 330 may apply elastic force to the second bearing 310 to push the second bearing 310 such that the second bearing 310 is exposed outwards toward the upper rod 100 along the pushing recess 320. When no external force is applied, therefore, the second bearing 310 may be exposed outwards toward the upper rod 100 due to the third elastic member 330.

As a result, the support rod 300 may smoothly slide along the upper rod 100 in the state in which the second bearing 310 is exposed out of the upper end portion of the support rod 300 by the third elastic member 330. However, when the user sits down, i.e., when the support rod 300 is pushed, the second bearing 310 is inserted into the support rod 300 against the elastic force of the third elastic member 330, whereby the second bearing 310 is protected from external force and is thus prevented from being damaged.

As is apparent from the above description, the wearable chair having the four-link structure according to an exemplary embodiment of the present invention has an effect in that, when a user sits down, the lower end portion of the lower rod is located to be spaced from the foot of the user, whereby sitting stability is improved.

Furthermore, the wearable chair having the four-link structure according to an exemplary embodiment of the present invention has an effect in that, in the state in which the user is standing, the lower end portion of the lower rod remains raised so as not to contact the ground, whereby interference with walking of the user is minimized.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A wearable chair having a link structure, the wearable chair comprising:

an upper rod extending in a longitudinal direction thereof;

a lower rod, wherein a first end portion of the lower rod is rotatably coupled to a first end portion of the upper rod;

a lower leg fixing unit slidably coupled to the lower rod to selectively slide in a longitudinal direction of the lower rod, wherein a distance between the lower leg fixing unit and the lower rod is varied when the lower leg fixing unit slides in the longitudinal direction of the lower rod; and a support rod having a first end portion rotatably coupled to the lower rod and a second end portion slidably coupled to the upper rod to slide within a predetermined section of the upper rod, wherein the upper rod is configured to be connected to a rear of a thigh of a user, wherein the lower rod is configured of extending from a rear of a lower leg of the user in the longitudinal direction of the lower rod, wherein a second end portion of the lower rod is configured to contact a ground when the user sits down, wherein the lower leg fixing unit is configured of extending in the longitudinal direction of the lower leg of the user to be coupled to the rear of the lower leg of the user, and wherein the wearable chair further includes:

a sliding unit slidably coupled to the lower rod to slide in the longitudinal direction of the lower rod;

a first connection unit coupled to the sliding unit and to a first portion of the lower leg fixing unit; and a second connection unit having a first end portion rotatably coupled to a second portion of the lower leg fixing unit and a second end portion rotatably coupled to a portion of the lower rod.

2. The wearable chair according to claim 1, wherein when the sliding unit slides along the lower rod, the second connection unit is rotated with respect to the lower rod so that the distance between the lower leg fixing unit and the lower rod is varied.

3. The wearable chair according to claim 1, wherein a rail is provided on the lower rod in the longitudinal direction of the lower rod, and the sliding unit is selectively slidable along the rail in the longitudinal direction of the lower rod.

4. The wearable chair according to claim 1, wherein the lower rod includes a first elastic member connected to the lower rod and the sliding unit for applying elastic force in a direction in which the sliding unit is pulled in a first direction, and wherein when the sliding unit slides in the first direction due to the elastic force of the first elastic body, the lower rod moves in a second direction opposite to the first direction from the lower leg fixing unit, so that the distance between the lower leg fixing unit and the lower rod is reduced.

5. The wearable chair according to claim 1, wherein when the lower rod is pushed by an external force and thus the sliding unit slides in a second direction, the lower rod moves in a first direction from the lower leg fixing unit, so that the distance between the lower leg fixing unit and the lower rod is increased.

6. A wearable chair having a link structure, the wearable chair comprising:

an upper rod extending in a longitudinal direction thereof;

a lower rod, wherein a first end portion of the lower rod is rotatably coupled to a first end portion of the upper rod;

a lower leg fixing unit slidably coupled to the lower rod to selectively slide in a longitudinal direction of the lower rod, wherein a distance between the lower leg fixing unit and the lower rod is varied when the lower leg fixing unit slides in the longitudinal direction of the lower rod;

a support rod having a first end portion rotatably coupled to the lower rod and a second end portion slidably coupled to the upper rod to slide within a predetermined section of the upper rod; and a switch slidably coupled to the upper rod to slide in the longitudinal direction of the upper rod and to be selectively fixed at at least a point among a plurality of points of the upper rod such that sliding of the switch is stopped, wherein when the switch is fixed at the at least a point of the upper rod, sliding of the support rod along the upper rod is stopped by the switch, whereby relative rotation between the upper rod and the lower rod is prevented.

7. The wearable chair according to claim 6, wherein a portion of the switch is provided with a coupling protrusion protrudingly formed toward the upper rod, wherein the upper rod is provided at the plurality of points of the upper rod with coupling recesses, and wherein when the coupling protrusion is inserted into at least one of the coupling recesses, the switch is fixed to the upper rod and the sliding of the switch along the upper rod is stopped.

8. The wearable chair according to claim 7, wherein the switch includes:

a body portion, on which the coupling protrusion is formed; and a rotation member rotatably coupled to the body portion, wherein when the rotation member is rotated relative to the body portion, a first end portion of the rotation member is exposed in a direction in which the coupling protrusion is protrudingly formed and thus the coupling protrusion is separated from the at least one of the coupling recesses.

9. The wearable chair according to claim 8, wherein a first bearing is rotatably mounted at the first end portion of the rotation member, and wherein when the rotation member is rotated relative to the body portion, the first bearing is exposed in a direction in which the coupling protrusion is protrudingly formed and thus the coupling protrusion is separated from the at least one of the coupling recesses.

10. The wearable chair according to claim 8, wherein the body portion includes a receiving hole, and wherein the rotation member is rotatably coupled to the body portion in the receiving hole.

11. The wearable chair according to claim 8, wherein the body portion is provided with a support member protrudingly formed in a direction opposite a direction in which the coupling protrusion is protrudingly formed, wherein a second end portion of the rotation member extends to be mounted at an oblique angle relative to the support member, and wherein when the second end portion of the rotation member is pushed toward the support member, the rotation member is rotated relative to the body portion.

12. The wearable chair according to claim 8, further including:

a second elastic member coupled to a portion of the lower rod and the first end portion of the support rod.

13. The wearable chair according to claim 8, wherein the support rod is provided at the first end portion thereof with a second bearing configured to be rotated such that the support rod slides along the upper rod.

14. The wearable chair according to claim 13, wherein the first end portion of the support rod includes a pushing recess and the second bearing is slidably coupled to the pushing recess of the support rod, the second bearing selectively moving in the pushing recess formed in the first end portion of the support rod such that the second bearing is exposed out of the support rod toward the upper rod or is inserted into the support rod.

15. The wearable chair according to claim 14, wherein the support rod is provided with a third elastic member for pushing the second bearing such that the second bearing is selectively exposed by elastic force of the third elastic member toward the upper rod along the pushing recess.

* * * * *